US006123055A

United States Patent [19]

Takeuchi et al.

[11] Patent Number: 6,123,055

[45] Date of Patent: Sep. 26, 2000

[54] CYLINDER HEAD STRUCTURE

[75] Inventors: Makoto Takeuchi; Tomoaki Kakihara; Hidetsugu Watanabe; Jun Otsuka; Toshiyuki Usui; Kouhei Yamaishi, all of Fujisawa, Japan

[73] Assignee: Isuzu Motors Limited, Tokyo, Japan

[21] Appl. No.: 09/253,284

[22] Filed: Feb. 19, 1999

[30] Foreign Application Priority Data

Feb. 25, 1998 [JP] Japan ..... 10-043772
Feb. 25, 1998 [JP] Japan ..... 10-043773

[51] Int. Cl.[7] ..... F02F 1/24

[52] U.S. Cl. ..... 123/193.5

[58] Field of Search ..... 123/193.5, 193.3, 123/193.2, 90.27

[56] References Cited

U.S. PATENT DOCUMENTS 4,658,763 4/1987 Gobien et al. ..... 123/193.5
5,535,714 7/1996 Aoyama et al. ..... 123/193.5
5,845,616 12/1998 Schwarzenthal et al. ..... 123/193.5
5,964,196 10/1999 Sigle et al. ..... 123/193.5

*Primary Examiner*—Marguerite McMahon
*Attorney, Agent, or Firm*—McCormick, Paulding & Huber LLP

[57] ABSTRACT

A cylinder head structure for an engine, including grooves (18; 12*a*) in a top surface (2; 2*a*) of a cylinder head body (1; 1*a*) such that they surround an associated a fuel injection nozzle hole (11; 8*a*). Valve tappet guide holes (6; 3*a*) are also formed in the top surface (2; 2*a*) of the cylinder head body (1; 1*a*) around each of the fuel injection nozzle holes (11; 8*a*). The grooves (18; 12*a*) connect the adjacent tappet guide holes (6; 3*a*) and surround the associated nozzle or spark plug hole. Cylinder head bolt holes (15; 9*a*) are also formed around the tappet guide holes (6; 3*a*). When cylinder head bolts are tightened to join the cylinder head with a cylinder block, a radiant tension (F) is generated from the cylinder head bolt heads which are in contact with the cylinder head top surface. This radiant tension would cause cracking around the injection nozzle hole (11; 8*a*). The grooves (18; 12*a*) interrupt transmission of the radiant tension to the vicinity of the injection nozzle hole to prevent occurrence of cracking.

10 Claims, 8 Drawing Sheets

CYLINDER HEAD STRUCTURE

BACKGROUND OF THE INVENTION

1. Field of the Invention

The present invention relates to a cylinder head structure for an engine.

2. Description of the Related Art

Referring to FIG. 8 of the accompanying drawings, illustrated is a plan view of a cylinder head a of a four-valve center-nozzle type diesel engine. This engine has four cylinders in series (not shown). As illustrated, the cylinder head a includes a plurality of block portions b for a plurality of cylinders of the engine respectively. Each block portion b defines a plurality of valve tappet guide holes d to receive valve tappets (not shown) respectively. The cylinder head a also includes seat portions c on which heads of cylinder head bolts seat when the cylinder head bolts are tightened to join the cylinder head with a cylinder block (not shown).

Each block portion b has four valve tappet guide holes d formed in a top surface e (indicated by the oblique lines) of the cylinder head a for each cylinder, and a single fuel injection nozzle hole f at the center of the four tappet guide holes d for each cylinder. Cylindrical valve tappets are received in the guide holes d such that they can move in axial directions of respective valves (intake or exhaust valves: not shown). Each of the valve tappets has a top surface which contacts an associated cam of a cam shaft (not shown) and has a bottom surface which abuts an upper end of a valve shaft (stem) of the associated valve, so that it forces the valve shaft downward and upward to open and close the associated valve upon rotations of the cam shaft.

Each of the seat portions c has a bolt hole g into which an associated cylinder head bolt inserted. The cylinder head bolts are inserted into the bolt holes g from the top surface e of the cylinder head a, and lower end stem portions are threaded into female threads formed in the cylinder block until bolt heads seat on seating surfaces h of the seat portions c. These head bolts firmly unite the cylinder head a with the cylinder block.

The seating surfaces h for the cylinder head bolts are coplanar to the top surface e of the cylinder head a so that they are substantially continuous to the top surface i of the block portions b. Further, six seating surfaces h surround one block portion b for each cylinder at predetermined intervals such that they are arranged around an associated cylinder bore in the plan view.

When the head blots are inserted in the bolt holes g and tightened to join the cylinder head a to the cylinder block, axial tensions of the head bolts press down the seating surfaces h by the bolt heads and therefore radiant tensile forces F are generated in the top surfaces i of the block portions b as indicated by the arrows in FIG. 8 since each of the block portions b is surrounded by the six seating surfaces h. In addition, the cylinder head a is subjected to a pressure as combustion takes place in the cylinders, but it is restricted by the cylinder head bolts (specifically at the bolt heads and seating surfaces h), so that similar tensile forces F are also generated in the top surfaces i of the block portions b by the combustion pressure.

These tensions F are concentrated to the top surfaces i including a shallow area from the top surfaces i. As the tensions F are produced in the top surfaces i of the block portions b for the respective cylinders, they are concentrated to the thinnest or narrowest interportions j between the tappet guide holes d and nozzle holes f. This would cause cracking k in the thin interportions j. The cracking k likely occurs if the cylinder head a is made of an aluminum or its alloy. The engines are often made of the aluminum to reduce the engine weight.

SUMMARY OF THE INVENTION

An object of the present invention is to provide a cylinder head structure to prevent cracking which would otherwise be caused in a top surface of a cylinder head due to a tension generated in the cylinder head top surface.

According to one aspect of the present invention, there is provided a cylinder head structure for a vehicle's engine, including a cylinder head body, a plurality of block portions formed in the cylinder head body for a plurality of engine cylinders respectively, each block portion including a plurality of valve tappet guide holes to receive valve tappets respectively, cylinder head bolt holes formed in the cylinder head body around the valve tappet guide holes, and seat portions each formed at a top of each of the cylinder head bolt holes such that heads of the cylinder head bolts sit thereon when the cylinder head blots are inserted into the cylinder head bolt holes and tightened to unite the cylinder head body with a cylinder block, characterized in that top surfaces of the block portions are separated from seating surfaces of the seat portions. When the cylinder head bolts are inserted in the bolt holes and tightened, a head of each of the cylinder head bolts presses the seating surface of the associated seat portion downward and a radiant tension is generated in the seating surface. In the cylinder head structure of the invention, however, the seating surfaces are separated from the top surfaces of the block portions so that the radiant tension is not transmitted to the top surfaces of the block portions. Accordingly, the top surfaces of the block portions are not subjected to the radiant tension and cracking would not occur in the top surface of the cylinder head. In particular, if a fuel injection nozzle hole or spark plug hole is formed at the center of each block portion, thin interportions between the nozzle hole (or spark plug hole) and the valve tappet guide holes tend to crack due to the radiant tension, but it is prevented in the present invention.

The seating surfaces of the seat portions may be formed to be lower than the top surfaces of the block portions so that the seating surfaces are separated from the top surfaces of the block portions in a height direction of the cylinder block body.

Cutouts, grooves or cavities may be formed in walls between the seating surfaces of the seat portions and the top surfaces of the block portions. Transmission routes for the radial tension toward the top surfaces of the block portions from the seat portions when the heads of the cylinder head bolts are forced against the seating surfaces are partly eliminated by the cutouts so that the radial tension is difficult to reach the top surfaces of the block portions. Consequently, no or less radial tension is generated in the top surfaces of the block portions and occurrence of the cracks will be prevented or restrained in the top surface of the cylinder head.

A plurality of second grooves may be formed in the top surfaces of the block portions such that they connect the adjacent tappet guide holes with each other. The radial tension generated in the seat portions upon tightening the cylinder head bolts is interrupted by the second grooves and therefore occurrence of cracking in the top surfaces of the block portions is prevented.

The cylinder head body may be made of aluminum or aluminum alloy. Since the radial tension is not (or less)

applied to the top surfaces of the block portions, the cracks would not occur in the top surface of the cylinder head body even if the cylinder head body is made of the aluminum which is a relatively weak material.

According to the second aspect of the present invention, there is provided a cylinder head structure for an engine including a cylinder head body, valve tappet guide holes formed in the top surface of the cylinder head body such that a plurality of valve tappet guide holes are associated with each engine cylinder, a plurality of fuel injection nozzle or spark plug holes formed in the top surface of the cylinder head body for a plurality of engine cylinders respectively such that each of the fuel injection nozzle or spark plug holes is surrounded by the associated plurality of valve tappet guide holes, and a plurality of grooves formed in the top surface of the cylinder head body around each nozzle or spark plug hole such that they connect the adjacent tappet guide holes surrounding the associated nozzle or spark plug hole.

The cross sectional shape of the grooves may be semi-circular. The semi-circular cross section can avoid concentration of a stress in the groove as compared with a square or rectangular cross section.

The width of the grooves may expanded toward the associated nozzle or spark plug hole such that the grooves are made continuous around the associated nozzle or spark plug hole.

The cylinder head body may be made of aluminum or its alloy. The grooves formed in the top surface of the cylinder head body interrupt transmission of radiant tension from the head bolt holes so that cracking does not occur in the top surface of the cylinder head body even if the cylinder head is made of an aluminum.

DETAILED DESCRIPTION OF THE INVENTION

Now, embodiments of the present invention will be described in reference to the accompanying drawings.

First Embodiment:

A first embodiment will be described in reference to FIGS. 1 through 3.

Figure 1:
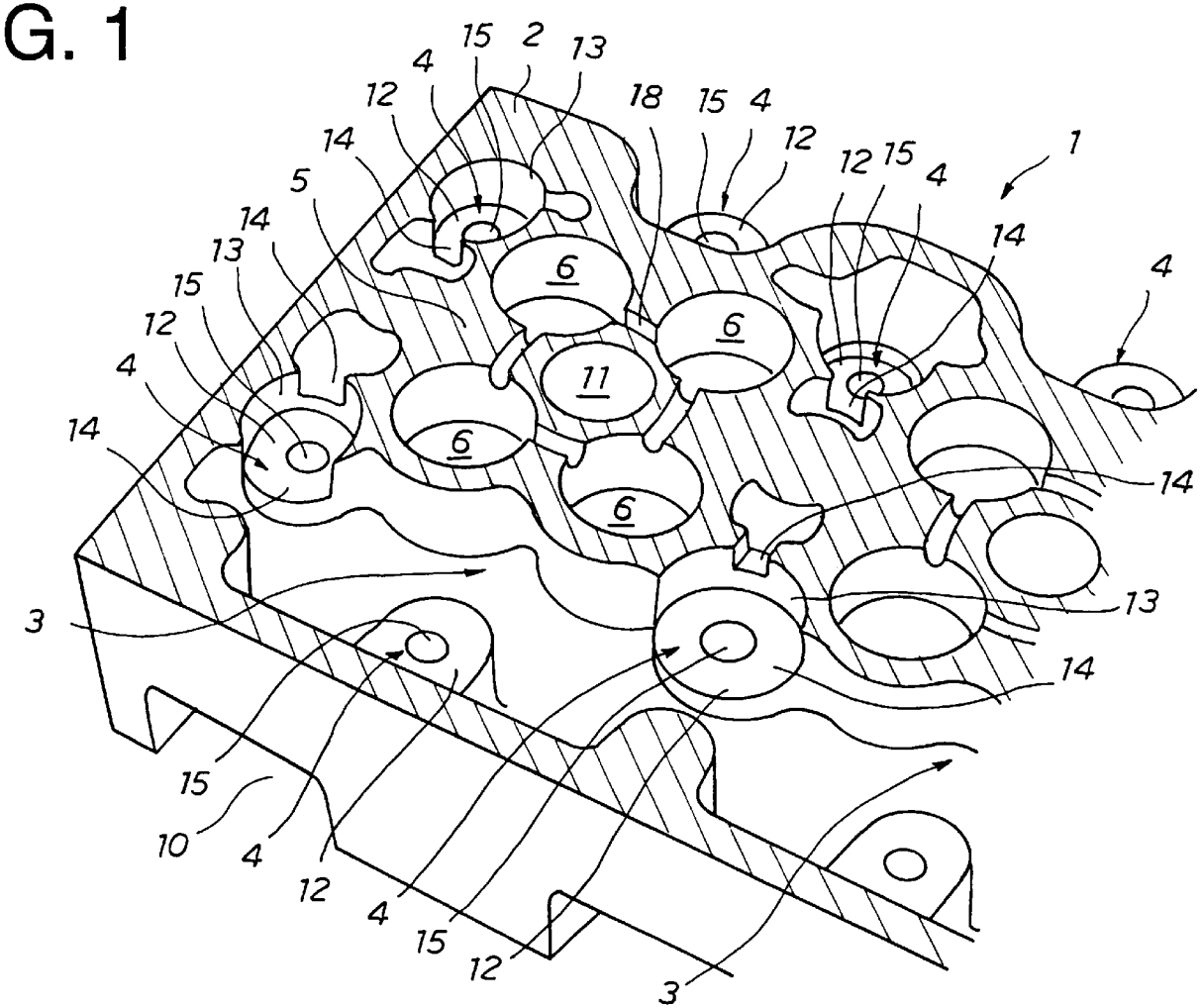
FIG. 1 illustrates a partial perspective view of a cylinder head structure according to the first embodiment of the present invention.
Figure 2:
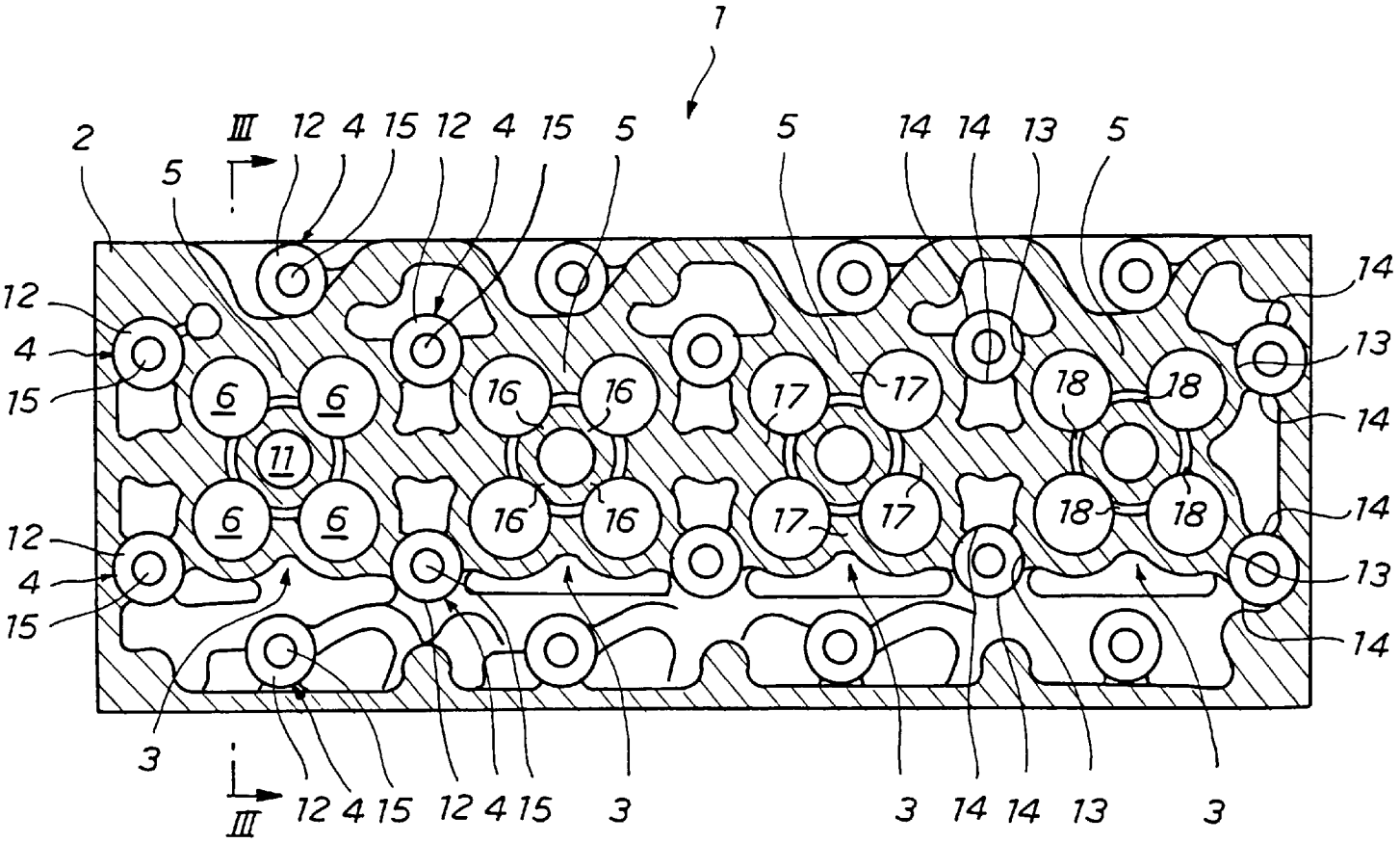
FIG. 2 illustrates a plan view of the cylinder head structure shown in FIG. 1.

Referring to FIGS. 1 and 2, a cylinder head 1 is made of aluminum or its alloy and is generally shaped to rectangular parallelepiped. A top surface 2 of the cylinder head 1 as indicated by the oblique lines is a flat planar surface. The cylinder head 1 includes a plurality of block portions 3 for a plurality of cylinders of an engine respectively. Each of the block portions 3 supports four valve tappets (not shown) in this embodiment. The cylinder head 1 also includes a plurality of seating portions 4 on which heads of cylinder head bolts (not shown) seat when the cylinder head bolts are tightened to join the cylinder head 1 with a cylinder block (not shown). In the illustrated embodiment, six seating portions 4 are provided for each of the engine cylinders.

Each block portion 3 has a top surface 5 which is coplanar to the top surface 2 of the cylinder head body 1. Four tappet guide holes 6 are formed in the top surface 5 of each block portion 3 for each engine cylinder. Four cylindrical valve tappets are received in the four guide holes 6 respectively such that they can move in axial directions of associated valves respectively.

Each of the valve tappets has an upper end face which contacts a cam of a cam shaft (not shown) and a lower end face which contacts a top of a stem of a valve (intake or exhaust valve) so that it forces the associated valve stem downward and upward upon rotations of the cam shaft, thereby opening and closing the associated valve.

Figure 3:
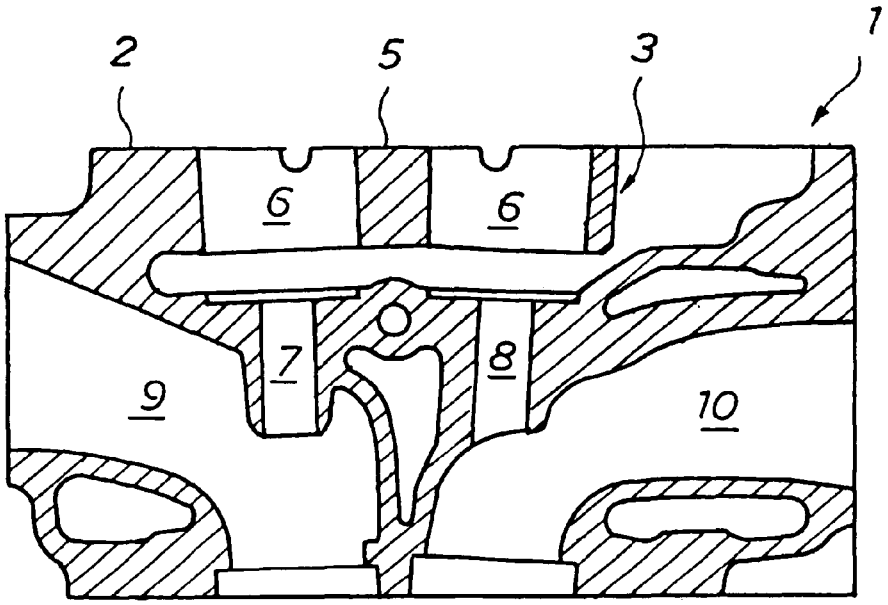
FIG. 3 illustrates a cross sectional view taken along the line III—III of FIG. 2.

In FIG. 3, a reference numeral 7 designates a hole to support the intake valve stem, 8 a hole to support the exhaust valve stem, 9 an intake port and 10 an exhaust port.

As shown in FIG. 1, a fuel injection nozzle hole 11 is provided at the center of the four tappet guide holes 6 in the top surface 5 of each block portion 3 for each cylinder. Thus, the engine of this embodiment is a direct-injection, four-valve, center-nozzle type diesel engine. It should be noted that the present invention is also applicable to a four-valve gasoline engine which has a spark plug in the hole 11 instead of the injection nozzle.

The seat portions 4 are spacedly arranged to surround each of the block portions 3. The seating surfaces 12 of the seat portions 4 are lower than the top surfaces 5 of the block portions 3, i.e., the top surface 2 of the cylinder head 1. Therefore, the seating surfaces 12 of the seat portions 4 are separated from the top surfaces 5 of the block portions 3 in a height direction of the cylinder head 1. In walls 13 connecting the seating surfaces 12 of the seat portions 4 with the top surfaces 5 of the block portions 3, formed are cutouts 14 as illustrated in FIGS. 1 and 2. The cutouts 14 reduce transmission routes for a radiant tension (F in FIG. 8), which is generated in the seating surfaces 12 of the seat portions 4 and tend to act on the top surfaces 5 of the block portions 3 as the cylinder head bolts are tightened. (The radiant tension is derived from axial forces applied to the seating surfaces 12 from the cylinder head bolts.) Therefore, a smaller tension is only transmitted to the top surfaces 5 of the block portions 3.

Cylinder head bolt holes 15 are formed in the seat portions 4 respectively. The cylinder head bolts are inserted into these holes 15 from the top surface 2 of the cylinder head 1 and screwed into threads formed in a cylinder block until the cylinder head bolt heads sit on the seating surfaces 12 of the cylinder head 1 to join the cylinder head 1 with the cylinder block.

Now, working of this embodiment will be described.

Figure 8:
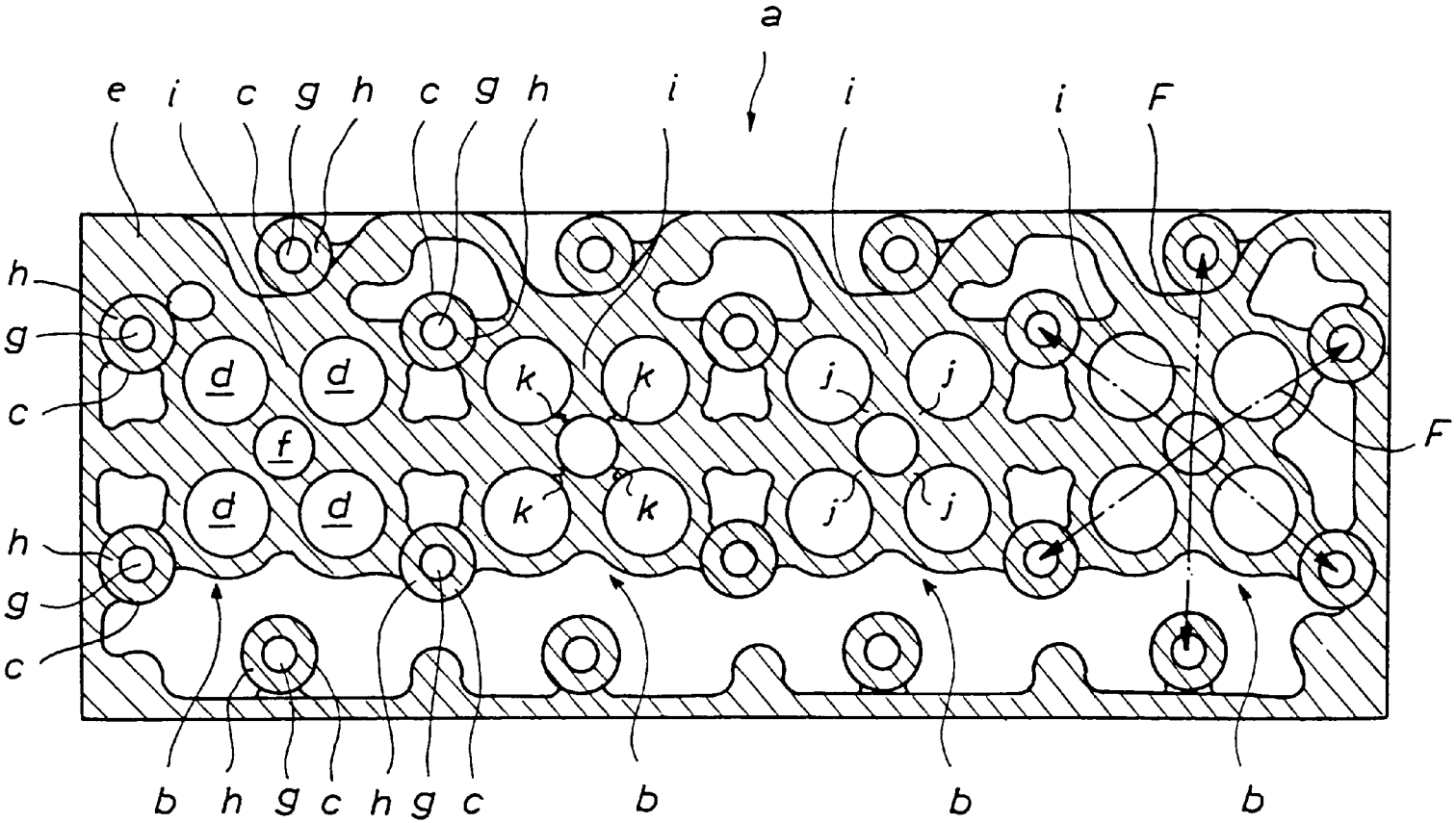
FIG. 8 illustrates a plan view of the conventional cylinder head structure.

Since the grooves or cavities 14 are formed between the seating surfaces 12 and the top surfaces 5 of the block portions 3 and the force transmission routes are reduced, the axial forces imposed on the seating surfaces 12 by the cylinder head bolt heads upon tightening the cylinder head bolts are difficult to be transmitted to the top surfaces 5 of the block portions 3 in the form of radiant tension (F) as compared with the cylinder head structure shown in FIG. 8.

As a result, a smaller radial tension (F) is only produced in the top surfaces 5 of the block portions 3 and crackings due to the radial tension is avoided. In particular, the cracks (k in FIG. 8) do not occur in the interportions 16(*j*) between the nozzle holes 11(*f*) and the surrounding tappet guide holes 6(*d*) in the illustrated embodiment. This is important because the cylinder head body 1 is made of aluminum of which mechanical strength is relatively weak.

In this embodiment, four grooves 18 are also formed in the top surface 5 of each block portion 3 such that they connect adjacent tappet guide holes 6 as illustrated in FIGS. 1 and 2. These four grooves 18 surround the associated nozzle hole 11. It can also be said that the grooves 18 extend through portions 17 lying between the adjacent tappet guide holes 6. Therefore, even if a tension (F) is more or less generated in the top surface 2 of the cylinder head 1, it is interrupted by the grooves 18 so that the tension is not transmitted to the thinnest, easy-to-crack portions 16 around the nozzle hole 11. In the described and illustrated embodiment, therefore, occurrence of cracking in the top surface 2 of the cylinder head 1 is prevented by combination of the cavities 14 and grooves 18. The cross section of the grooves 18 is generally semi-circular.

Figure 4:
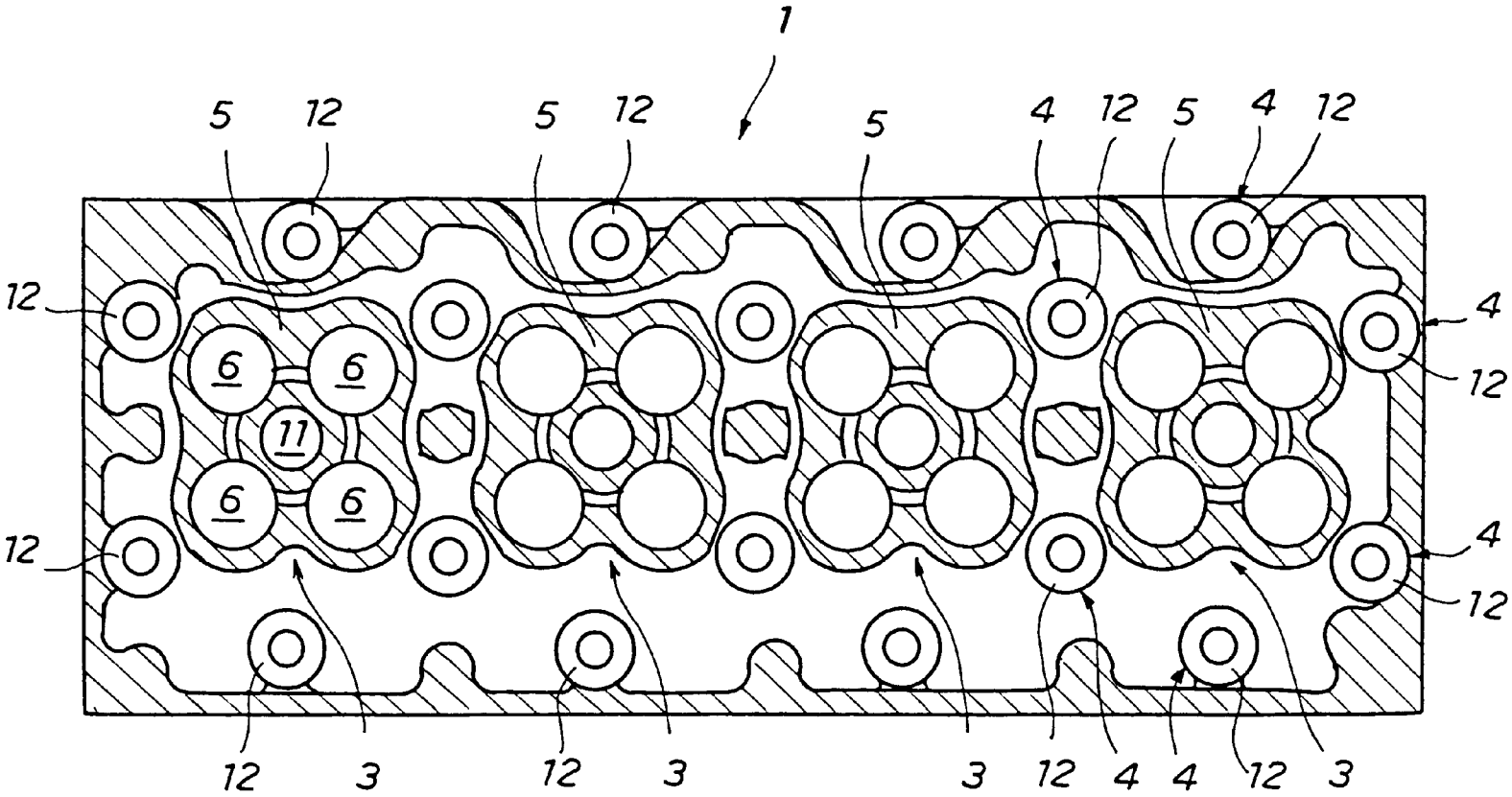
FIG. 4 illustrates a plan view of a modified cylinder head structure according to the present invention.

Referring now to FIG. 4, illustrated is a modification to the first embodiment. Similar reference numerals are used in FIGS. 1 to 4. In this modification, the block portions 3 are completely separated from the seat portions 4 when viewed from the top. The block portions 3 and the seat portions 4 are integrated to the cylinder head body 1 at their lower bodies by casting of the like. The seating surfaces 12 of the seat portions 4 may be lower than the top surfaces 5 of the block portions 3 or at the same height.

The downward axial forces imposed on the seating surfaces 12 by the cylinder head bolt heads are not applied to the top surfaces 5 of the block portions 3 since the seating surfaces 12 are separated from the top surfaces 5 of the block portions 3. Therefore, the radiant forces (F) are not generated in the top surfaces 5 of the block portions 3 upon tightening the head bolts, and crackings do not occur due to the radiant forces.

In the first embodiment and its modification, there are four block portions 3 arranged in series since the engine is a straight four-cylinder engine. However, the present invention is not limited to such an engine. Further, four tappet guide holes 6 are formed for each nozzle hole 11 in the illustrated constructions since the engine is a four-valve engine. However, the engine may be a two-valve engine, three-valve engine or five-valve engine. In such cases, two, three or five tappet holes 6 may be formed around the single nozzle hole 11. Moreover, six seat portions 4 are formed for each cylinder and two of them are shared by the next cylinder in the above embodiment, but the present invention is not limited to the illustrated construction.

Second Embodiment:

Now, a second embodiment of the present invention will be described in reference to FIGS. 5, 6 and 7.

Figure 5:
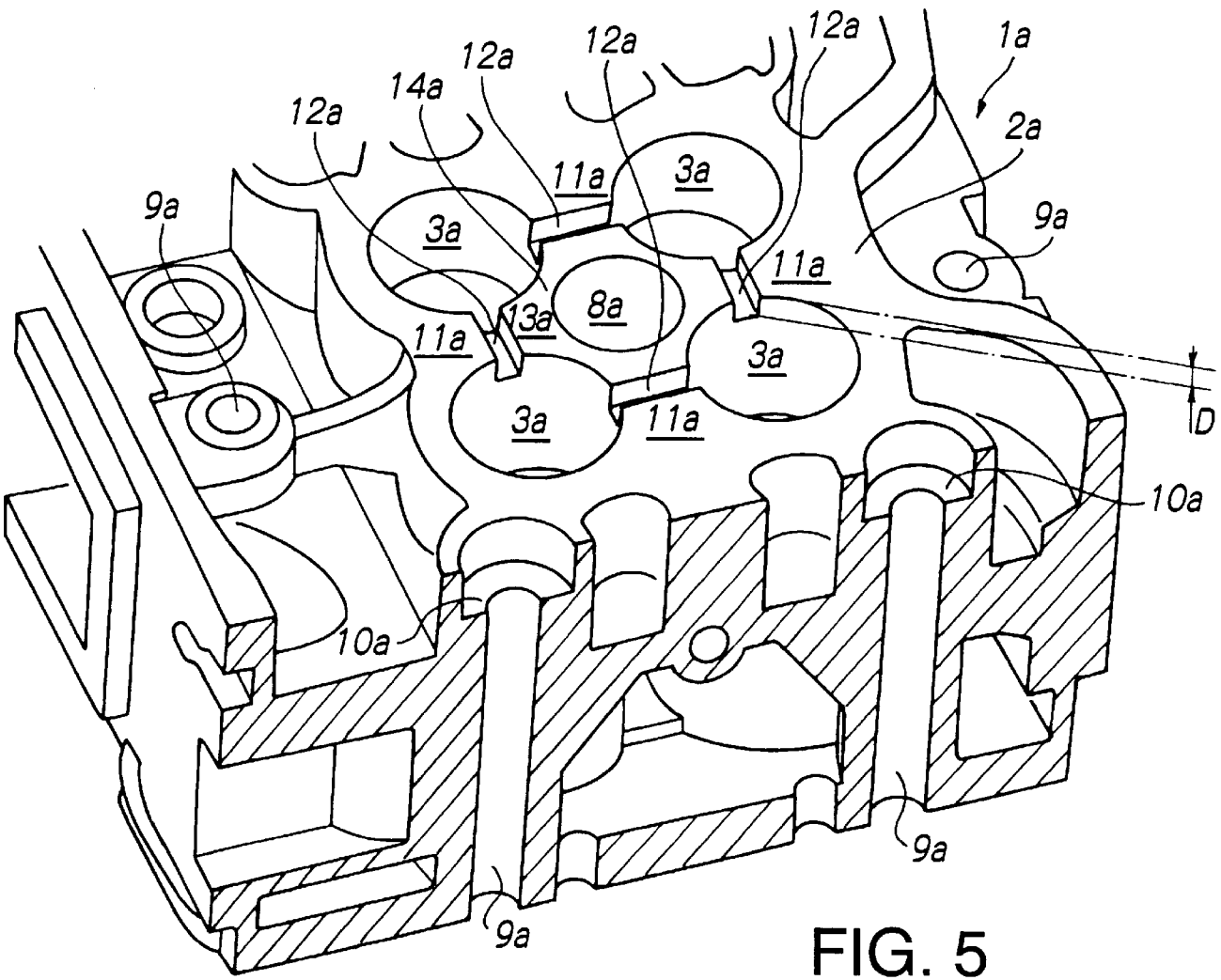
FIG. 5 is a partial perspective view of a cylinder head structure according to the second embodiment of the present invention.
Figure 6:
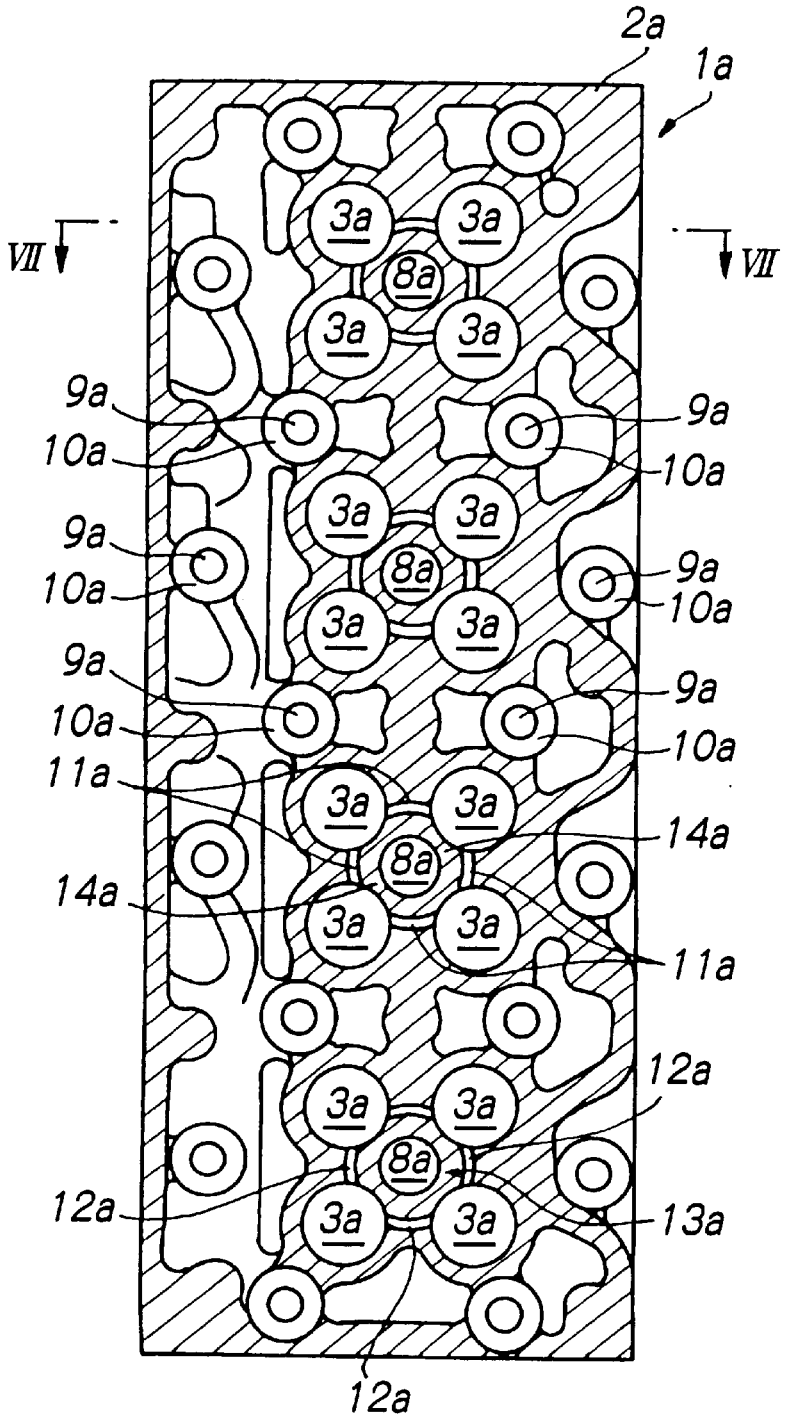
FIG. 6 is a plan view of the cylinder head shown in FIG. 5.

Referring to FIGS. 5 and 6, illustrated is a partial perspective view of a cylinder head structure according to the second embodiment. A cylinder head 1*a* is made of aluminum or its alloy and is generally shaped to rectangular parallelepiped. A top surface 2*a* of the cylinder head 1*a* (indicated by the oblique lines in FIG. 6) is a flat planar surface. The cylinder head 1*a* has four tappet guide holes 3*a* in its top surface 2*a* for each engine cylinder. The illustrated engine is a four-cylinder engine so that there are provided sixteen (16=4×4) tappet guide holes 3*a* in total. It should be noted that the invention is not limited to such an engine.

A cylindrical valve tappet (not shown) is received in each tappet guide hole 3*a* in such a manner that it can move in an axial direction of an associated valve stem. Each valve tappet has an upper end face in contact with a cam of a cam shaft (not shown) and a lower end face in contact with an upper end of a stem of a valve (intake or exhaust valve) so that it forces the associated valve stem downward and upward upon rotations of the cam shaft to open and close the associated valve.

Figure 7:
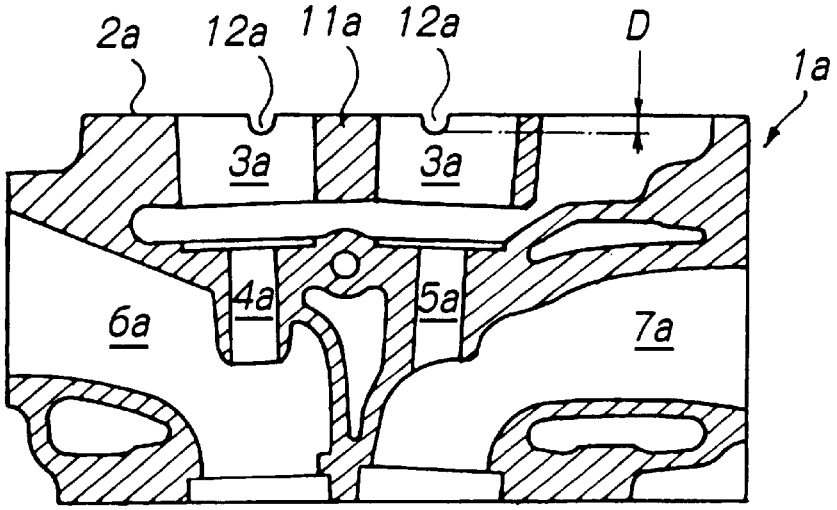
FIG. 7 is a cross sectional view taken along the line VII—VII of FIG. 6.

In FIG. 7, a reference numeral 4*a* designates a hole supporting the intake valve stem, 5*a* a hole supporting the exhaust valve stem, 6*a* an intake port and 7*a* an exhaust port.

As shown in FIG. 5, a fuel injection nozzle hole 8*a* is formed at the center of the four tappet guide holes 3*a* in the top surface 2*a* of the cylinder head 1*a* for each cylinder. A fuel injection nozzle (not shown) is mounted in each nozzle hole 8*a*. Therefore, the illustrated engine is a direct-injection four-valve center-nozzle diesel engine. It should be noted that the present invention is also applicable to a four-valve gasoline engine which has a spark plug in the hole 8*a* instead of the injection nozzle.

Cylinder head bolt holes 9*a* are formed in the cylinder head body 1*a* and cylinder head bolts are inserted in these holes 9*a* and tightened to join the cylinder head body 1*a* to a cylinder block (not shown). Six bolt holes 9*a* are spacedly provided to surround a single cylinder bore and associated four tappet guide holes 3*a* for each engine cylinder. In the illustrated embodiment, two of the six bolt holes 9*a* for one cylinder are shared by the next cylinder as best seen in FIG. 6. It should be noted, however, that the present invention is not limited to this construction.

The cylinder head bolts are inserted in the bolt holes 9*a* from the top surface 2*a* of the cylinder head 1*a* and threaded into female threads formed in the cylinder block until the bolt heads are seated on seating surfaces 10*a* of the cylinder head 1*a*. This tightening operation firmly unites the cylinder head 1*a* with the cylinder block. Each of the seating surfaces 10*a* is formed around the upper periphery of the associated bolt hole 9*a* and is positioned lower than the top surface 2*a* of the cylinder head 1*a*.

Grooves 12*a* are formed in the top surface 2*a* of the cylinder head 1*a* such that they connect the adjacent tappet guide holes 3*a*. The four grooves 12*a* are provided for each cylinder so that each of the injection nozzle holes 8*a* is surrounded by the four grooves 12*a*. These four grooves 12*a* define a generally annular are a 13*a* around the nozzle hole 8*a*. Reference numeral 11*a* designates an area lying between the adjacent tappet guide holes 3*a* so that it can be said that the grooves 12*a* extend through these intermediate areas 11*a*. As best illustrated in FIG. 5, the cross sectional view of the groove 12*a* is square or rectangular in this particular embodiment, but the groove 12*a* is preferably shaped to have a semi-circular cross section as shown in FIG. 7 since the square cross section would cause a stress to be concentrated on corners of the square. The depth D of the groove 12*a* is designed to be sufficient to interrupt the radial tension (F in FIG. 8) generated in the top surface 2*a* of the cylinder block 1*a* (including a certain depth or shallow area from the top surface 2*a*) upon tightening of the head bolts. In FIG. 6, the grooves 12*a* extend in an arc shape when viewed from the top, but it may extend straight.

Now, working of this embodiment will be described.

When the cylinder head bolts are inserted in the head bolt holes 9*a* and tightened to unite the cylinder head 1*a* with the cylinder block, the radiant tension (F) is generated in the top surface 2*a* of the cylinder head 1*a* around each of the head bolt holes 9*a*. In this embodiment, however, transmission of the radiant tension (F) in the cylinder head top surface 2*a* is discontinued by the grooves 12*a* formed in the cylinder head top surface 2*a*. Therefore, the radiant tension is not applied to the area 13*a* around the nozzle hole 8*a*.

Accordingly, the areas 13*a* around the nozzle holes 8*a* are insulated from the radiant tension (F) generated in the top surface 2*a* of the cylinder head 1*a,* and no stress is applied to the areas 13*a* due to the radiant tension. Thus, unlike the conventional structure shown in FIG. 8, cracking (k in FIG. 8) does not occur in the thinnest areas 14*a*(*j*) between the tappet guide holes 3*a*(*d*) and the nozzle holes 8*a*(*f*) in the embodiment of the invention. Cracks are not generated even if the cylinder head body 1*a* is made of aluminum or its alloy of which mechanical strength is weak since the radiant tension (F) from the cylinder head bolts is interrupted by the grooves 12*a*.

Figure 6A:
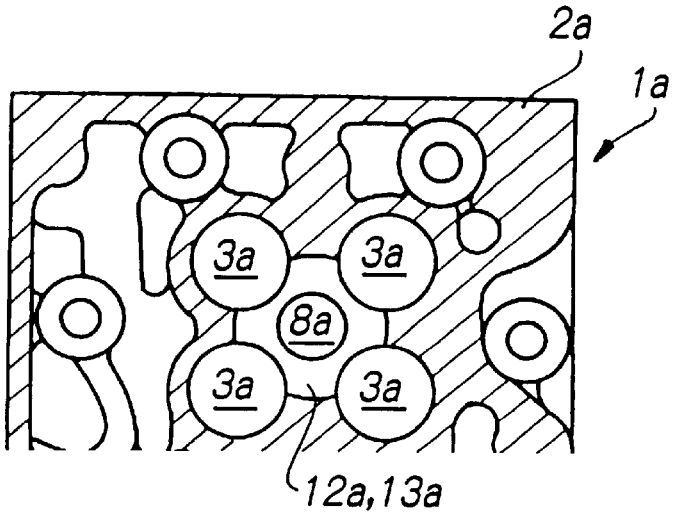
FIG. 6A illustrates a plan view of a modification to the second embodiment.

It should be noted that the present invention is not limited to the above embodiment. For example, as illustrated in FIG. 6A, the width of the groove 12*a* may be expanded toward the nozzle hole 8*a* so that four grooves 12*a* around each nozzle hole 8*a* are connected with each other. The areas 13*a* around the nozzle hole 8*a* are made coplanar to the grooves 12*a* so that the areas 13*a* are made lower than the cylinder head top surface 2*a*.

Other modifications and changes may be made by those having an ordinary skill in the art without departing from the spirit and scope of the present invention. Further, any combination of the foregoing constructions may also be possible as needed.

This application claims priority of Japanese Patent Application Nos. 10-43772 and 10-43773 both filed Feb. 25, 1998 and the entire disclosures thereof are incorporated herein by reference.

What is claimed is:

1. A cylinder head structure for a vehicle's engine, comprising:

a cylinder head body having a top surface located in a top plane defining the upper limit of said head body;

block portions formed in the cylinder head body for a plurality of engine cylinders respectively, each block portion including a plurality of valve tappet guide holes to receive valve tappets respectively with each of said guide holes extending upwardly to and ending at said top surface;

a plurality of cylinder head bolt holes formed in the cylinder head body around the valve tappet guide holes for receiving a plurality of head bolts respectively; and a plurality of upwardly facing seating surfaces each associated with a respective one of the cylinder head bolt holes for engagement with a head of one of the cylinder head bolts, the seating surfaces being separated from top surfaces of said block portions.

2. The cylinder head structure of claim 1, wherein the seating surfaces are located lower than the top surfaces of the block portions so that the seating surfaces are separated from the top surfaces of the block portions in a height direction of the cylinder block body.

3. A cylinder head structure for a vehicle's engine, comprising:

a cylinder head body;

block portions formed in the cylinder head body for a plurality of engine cylinders respectively, each block portion including a plurality of valve tappet guide holes to receive valve tappets respectively;

a plurality of cylinder head bolt holes formed in the cylinder head body around the valve tappet guide holes for receiving a plurality of head bolts respectively;

a plurality of seat portions, each having a seating surface around a periphery of an upper end of each of the cylinder head bolt holes for a head of each cylinder head bolt, the seating surfaces of the seat portions being separated from top surfaces of the block portions; and cutouts or grooves formed between the seating surfaces of the seat portions and the top surfaces of the block portions.

4. A cylinder head structure for a vehicle's engine, comprising:

a cylinder head body;

block portions formed in the cylinder head body for a plurality of engine cylinders respectively, each block portion including a plurality of valve tappet guide holes to receive valve tappets respectively;

a plurality of cylinder head bolt holes formed in the cylinder head body around the valve tappet guide holes for receiving a plurality of head bolts respectively;

a plurality of seat portions, each having a seating surface around a periphery of an upper end of each of the cylinder head bolt holes for a head of each cylinder head bolt, the seating surfaces of the seat portions being separated from top surfaces of the block portions; and a plurality of grooves formed in the top surfaces of the block portions for connecting the adjacent valve tappet guide holes with each other.

5. The cylinder head structure of claim 1, wherein the cylinder head body is made of aluminum or its alloy.

6. The cylinder head structure of claim 4, wherein a cross section of each of the grooves is generally semi-circular.

7. A cylinder head structure for an engine comprising:

a cylinder head body;

a plurality of valve tappet guide holes formed in a top surface of the cylinder head body in such a manner that more than one valve tappet guide hole is associated with each engine cylinder;

a plurality of fuel injection nozzle or spark plug holes formed in the top surface of the cylinder head body for a plurality of engine cylinders respectively in such a manner that each of the fuel injection nozzle or spark plug holes is surrounded by the more than one valve tappet guide hole; and a plurality of grooves formed in the top surface of the cylinder head body around each nozzle or spark plug hole in such a manner that they connect the adjacent tappet guide holes.

8. The cylinder head structure of claim 7, wherein a cross sectional shape of the grooves is generally semi-circular.

9. The cylinder head structure of claim 7, wherein the grooves are expanded toward the associated nozzle or spark plug hole so that the grooves are made continuous around the associated nozzle or spark plug hole.

10. The cylinder head structure of claim 7, wherein the cylinder head body is made of aluminum or its alloy.

* * * * *